US008618903B2

(12) United States Patent
Fornasari et al.

(10) Patent No.: US 8,618,903 B2
(45) Date of Patent: Dec. 31, 2013

(54) POWER SUPPLY IMPROVEMENTS

(76) Inventors: Frank Fornasari, Emu Heights (AU); Clive Stuart White, Emu Heights (AU)

( * ) Notice: Subject to any disclaimer, the term of this patent is extended or adjusted under 35 U.S.C. 154(b) by 0 days.

(21) Appl. No.: 13/579,272

(22) PCT Filed: Feb. 16, 2011

(86) PCT No.: PCT/AU2011/000162

§ 371 (c)(1),
(2), (4) Date: Dec. 4, 2012

(87) PCT Pub. No.: WO2011/100791

PCT Pub. Date: Aug. 25, 2011

(65) Prior Publication Data

US 2013/0076476 A1 Mar. 28, 2013

(30) Foreign Application Priority Data

Feb. 16, 2010 (AU) ..... 2010900626
Aug. 27, 2010 (AU) ..... 2010903852

(51) Int. Cl.
*H01F 27/28* (2006.01)

(52) U.S. Cl.
USPC ..... 336/229

(58) Field of Classification Search
USPC ..... 336/220, 225–229, 233–234, 212, 214
See application file for complete search history.

(56) References Cited

U.S. PATENT DOCUMENTS

| | | | | |
|---|---|---|---|---|
| 2,907,945 | A * | 10/1959 | Bucci et al. | 336/229 |
| 2,992,386 | A | 7/1961 | Rosin | |
| 3,387,203 | A | 6/1968 | Munnelly | |
| 4,009,460 | A * | 2/1977 | Fukui et al. | 336/110 |
| 4,422,015 | A | 12/1983 | Nilssen | |
| 5,525,951 | A * | 6/1996 | Sunano et al. | 336/160 |
| 5,731,666 | A * | 3/1998 | Folker et al. | 315/276 |
| 7,443,274 | B2 * | 10/2008 | Lee et al. | 336/84 M |
| 7,474,193 | B2 * | 1/2009 | Na et al. | 336/229 |
| 7,561,387 | B2 * | 7/2009 | Miller et al. | 361/35 |

* cited by examiner

*Primary Examiner* — Tuyen Nguyen
(74) *Attorney, Agent, or Firm* — Richard C Litman

(57) ABSTRACT

A power supply apparatus which includes a transformer having a primary winding and a secondary winding, whereby magnetic flux generated by a varying primary voltage applied to the primary winding induces a varying secondary voltage on the secondary winding, a torroidal transformer core over which said primary winding and secondary winding are applied, and at least one magnetic shunt arranged to provide a diversion path for magnetic flux generated by the primary winding which diverts magnetic flux from the secondary winding.

13 Claims, 8 Drawing Sheets

POWER SUPPLY IMPROVEMENTS

TECHNICAL FIELD

This invention is involved with improvements in or relating to power supplies. In particular embodiments, the invention may be utilised to supply electrical power to low impedance electrical loads.

BACKGROUND TO THE INVENTION

Power supply systems designed to supply electrical energy to low impedance loads need to address a number of specific problems. When standard power supply transformer technology is used it is difficult to limit the ultimate output current delivered to a low, impedance load. Potentially high output currents can be generated using standard transformer technology for a low impedance load which can result in damage to the components of the power supply system and/or the load which is to be supplied with electrical energy.

One approach used to restrict the output current supplied to low impedance loads is to place a resistance in line with the load. The resistance used is selected to keep the output current of the transformer at manageable levels for the voltage required by the load. However, one problem associated with this resistant based approach is the amount of waste heat generated by the resistor which needs to be dissipated by the power supply system. To dissipate heat a power supply generally needs to incorporate a fan or other similar cooling components. Including these components can increase the size, complexity and overall cost of the power supply provided. Furthermore, where such power supplies are to be used in dusty or chemically corrosive environments, air driven by a cooling system through the housing of a power supply can over time damage the components of the supply.

The use of resistive elements to control transformer output current also degrades the power transfer efficiencies of the supply. In general terms, resistors deployed in line or in series with a load will not match the impedance of the load with that of the supply, thereby limiting the efficiency of power transfers completed through to the load.

Previous attempts at providing a power supply system designed to supply electrical energy to low impedance loads have been made. For example, U.S. Pat. No. 2,992,386 discloses a way of compensating for variations in the input voltage of a transformer, so that the output voltage of the transformer remains stable. This invention works by having a section of the transformer core which is "saturable" or non-linear. On this section is wound a coil, to which is connected a capacitor. The coil and capacitor combination is designed so that at the minimum operating voltage of the transformer, the coil/capacitor combination start to saturate the core. As the input voltage increases, the saturation of the core also increases, resulting in a change of the path taken by the magnetic flux of the transformer. The different flux path compensates for the increased input voltage.

One of the embodiments of the invention shown in U.S. Pat. No. 2,992,386 discloses the use of two separate transformers, one saturable and the other one wound as an auto-transformer. Whilst it is mentioned that a toroid could be used as the auto-transformer, there is no mention that a toroid could be used in conjunction with a "shunt" (or used as a saturable core).

U.S. Pat. No. 2,992,386 does not mention current limiting at all. Rather, the word "shunt" in this prior invention is used to describe an alternative magnetic path, which is used to provide voltage regulation. In this way, the operating principle of this prior invention relies on the effect of ferro-resonance. Furthermore, whilst a "toroid" is mentioned in the patent, it is mentioned in the context of a convenient way to incorporate an auto-transformer winding.

U.S. Pat. No. 4,422,015 discloses an invention to limit the current for an insect trap, which utilises magnetic shunts to introduce current limiting flux leakage. Accordingly, as the invention relates to an insect trap, the invention operates at high frequency (the circuits cited in this patent operate at frequencies of at least 30 Khz and do not produce large currents. Furthermore, the invention disclosed in U.S. Pat. No. 4,422,015 does not disclose the use of a toroid to introduce current limiting flux leakage.

U.S. Pat. No. 3,387,203 discloses a transformer arrangement which is a modification to a particular frequency generator design, which was typically used as a ring generator in telephone exchanges. In other words, the invention disclosed in U.S. Pat. No. 3,387,203 is not intended as a power supply.

The invention discloses a toroidal transformer which has been modified to eliminate an inductor from a prior-art frequency generator design. This is achieved by the separation of the transformer windings and the addition of a magnetic shunt. The resulting toroid and shunt arrangement was an upgrade to a prior-art frequency generator (see FIG. 2).

In order to work, the toroid and shunt arrangement need to be carefully designed and manufactured so as to be part of a tuned circuit. This invention requires precise air gaps between the shunts and the transformer core. The toroid core and the shunts are made from specific materials, in order to operate at the correct frequency and with the correct losses.

It would be of advantage to have an improved power supply and/or improvements available to existing power supplies which mitigated the above problems. In particular, an improved power supply capable of managing output currents while minimising the generation of waste heat would be of advantage. A power supply system which could also effectively match the impedance characteristics of the supply with the impedance of a particular load for efficient power transfers would also be of advantage.

SUMMARY OF THE INVENTION

According to one aspect of the invention there is provided a power supply apparatus which includes:— a transformer having a primary winding and a secondary winding, whereby magnetic flux generated by a varying primary voltage applied to the primary winding induces a varying secondary voltage on the secondary winding;

a torroidal transformer core over which said primary winding and secondary winding are applied; and at least one magnetic shunt arranged to provide a diversion path for magnetic flux generated by the primary winding which diverts said magnetic flux from the secondary winding.

According to a further aspect of the present invention, there is provided a power supply apparatus substantially as described above, wherein the primary winding is applied to an alternative portion of the torroidal core to the secondary winding.

According to yet another aspect of the present invention, there is provided a power supply apparatus substantially as described above wherein a magnetic shunt extends to and/or over the perimeter of the torroidal core.

According to a further aspect of the present invention, there is provided a power supply apparatus substantially as described above which includes a pair of magnetic shunts located on opposite sides of the torroidal core.

According to yet another aspect of the present invention, there is provided a power supply apparatus substantially as described above wherein a magnetic shunt is formed from laminated sections of transformer steel.

The present invention is adapted to provide a power supply apparatus or alternatively allow for the implementation of the number of modifications to existing power supply devices. The arrangement and configuration of the present invention may provide advantages over prior art power systems with respect to the supply of electrical power to low impedance loads. Such low impedance loads cause a unique set of difficulties for existing power supplies which generally can control the voltage supplied but have difficulty controlling the current drawn by loads. At low impedances, high currents can be drawn through the power supply resulting in possible damage to the supply and the load, and the generation of a significant amount of heat in the vicinity of the load.

For example, the present invention may be used in electrical arc welding applications in some instances, or in other embodiments in contact electro-plating applications. However, reference in general will be made to the present invention being used as the power supply of a weld cleaning apparatus similar to that disclosed in the applicant's prior International Patent Co-Operation Treaty Application, WO 2005/089968. However, those skilled in the art should appreciate that referring to the use of the present invention within weld cleaning applications should in no way be seen as limiting.

A power supply apparatus provided in accordance with the present invention includes at least one transformer having or including a primary winding and a secondary winding. Transformers are commonly used in electrical power supplies and rely on magnetic flux generated by a varying voltage applied to the primary winding inducing a varying secondary voltage on the secondary winding. Transformer technology uses robust components which are capable of operating a range of environments with minimal maintenance.

Transformers used in power supplies are capable of supplying a secondary voltage from the secondary winding to a load, where the secondary voltage is directly related to the voltage applied to the primary winding, number of turns present in the primary winding, and the number of turns present in the secondary winding. As should be appreciated by those skilled in the art, the secondary voltage supplied to a load can be controlled relatively easy through modifying these parameters—whereas the current supplied to a load cannot.

The present invention facilitates a mechanism for controlling the output or secondary current of a transformer through the provision of at least one magnetic shunt. A magnetic shunt can be provided and arranged within the geometry of a transformer to provide a diversion path for magnetic flux generated by the primary winding. This diversion path can divert magnetic flux from the secondary winding, thereby providing a leakage inductance within the transformer. The diversion path provided by the magnetic shunt in effect diverts magnetic flux from the secondary winding, ultimately reducing the maximum current which can be drawn by an electrical load connected to the secondary winding.

Preferably, the present invention includes a torroidal shaped core over which the primary and secondary windings are applied. Such a torroidal core may be formed from any appropriate material which can assist in managing the distribution of magnetic flux through the transformer during operation. For example, in some embodiments, iron or ferrous materials may be shaped as a torroid and provided as a core to the transformer.

In a preferred embodiment the primary windings of the transformer may be physically separated from the secondary windings of the transformer. In the case of a prior art power supply transformer it is the normal convention to interleave or concentrically wind both the primary and secondary windings together over a common core. However, interleaving the primary and secondary windings allows for the linkage of flux between the two windings sitting in close proximity to one another. Conversely, the present invention—through spatially separating two sets of windings—allows for the introduction of a magnetic shunt which can divert magnetic flux generated by the primary winding which would normally affect the secondary winding.

In another embodiment where the transformer incorporates a torroidal core, some secondary windings of the transformer may be separated from the primary winding by the shunt, in order to benefit from the effect of the shunt, and some secondary windings may be concentrically wound onto the primary, so as to not be affected by the characteristics of the shunt.

In yet another embodiment where the transformer incorporates a torroidal coil, some turns of a secondary winding may be separated from the primary winding by the shunt, and some windings may be wound concentrically or interleaved with the primary. Such a secondary winding may have taps along its length, and the affect of the shunt would be modified depending on which tap was used.

In a preferred embodiment where the transformer incorporates a torroidal core, the primary winding may be applied or wound around an opposite or opposed side of the core to the secondary winding. In a further preferred embodiment, the primary and secondary windings may be spaced apart from one another over the torroidal core by a distance allowing for the placement of a magnetic shunt between the two windings. This specific transformer geometry provides an effective diversion path for magnetic flux generated by the primary winding before it has a chance to influence the secondary winding.

In a preferred embodiment a transformer shunt may be formed from a length or body of material which provides a low reluctance diversion path for magnetic flux. Preferably, the material which defines or provides a magnetic shunt may be arranged relative to the primary and secondary windings so as to lay at least a portion of the shunt sits within the majority of the magnetic flux travelling through to the secondary windings.

In a further preferred embodiment where the present invention includes a torroidal core, a magnetic shunt may be formed from a length or bar of ferrous material which is arranged to extend across the centre of the torroid with the ends of the shunt extending to or past the outer perimeter of the torroidal core. This specific geometry of a magnetic shunt therefore will place at least the ends of the shunt as close as possible to the main path followed by magnetic flux through to the secondary winding. This arrangement of a magnetic shunt ensures that the shunt can perform to provide an appropriate leakage inductance and hence an effective diversion path.

However in an alternative embodiment to the present invention may not necessarily employ a magnetic shunt formed from a length or bar of suitable material. For example in one alternative embodiment a magnetic shunt may be formed from a flat ring shaped plate or torus of soft magnetic material with an insulating material sandwiched between this plate and the torroidal core. For example, in some instances a circular ring plate of magnetically soft iron with an insulative plastic coating applied can be disposed on the top or bottom of the transformer to provide a magnetic shunt. This circular or dished plate shunt can function effectively in conjunction to the present invention due to its complimentary shape to that of a torroidal core transformer.

Furthermore, in some instances a plate based magnetic shunt may be formed by a plurality of layered sections of soft magnetic material separated by layers of insulated material. Those skilled in the art should appreciate that multiple layers of such ring plates of soft magnetic material may be used in the construction of a magnetic shunt to suit the eventual load to be serviced by the power supply. Those skilled in the art should also appreciate that the dimensions or extent of such a ring shaped plate shunt can again be adjusted depending on the required performance characteristics of the resulting power supplied provided. Plate based shunts may be used which have diameters which place the plate inside the outer perimeter of the transformer, or alternatively outside of the outer perimeter of the transformer if required.

In some embodiments the present invention may incorporate more than one magnetic shunt. For example, in the case of a preferred embodiment where the transformer employed has incorporated a torroidal core, a pair of bar shaped magnetic shunts may be provided with one shunt located on the top face of the core and a second shunt located on the bottom face of the core. This arrangement of dual magnetic shunts provides a symmetrical design which also maximises the cross-sectional area of the material provided within the shunts. Increasing the cross-sectional area of the shunts to in turn lowers their magnetic reluctance and hence improves their ability to provide diversion paths for magnetic flux.

Furthermore, in an alternative embodiment where ring plate based shunts are employed, these plate based shunts may be located on both the upper and also on the lower or bottom face's of the core in a similar mater to that discussed above with respect to bar shaped magnetic shunts. Again those skilled in the art should appreciate that the present invention may be adapted to use a wide range of shunt geometries and also different shunts as required to meet the performance criteria desired from the resulting power supply.

In a preferred embodiment, a bar shaped magnetic shunt may be formed from slices or sections of transformer steel laminated to one another to form the required shape or dimensions of a shunt. Laminating separate sections of transformer steel together provides a magnetic shunt formed form a number of electrically isolated sections, thereby reducing the size of any eddy currents induced into the shunt itself by magnetic flux. Reducing eddy current effects within a magnetic shunt reduces heat generated within a shunt through its exposure to magnetic flux.

In a preferred embodiment, a control coil may be provided in association with a magnetic shunt. Such a control coil can be employed to dynamically modify the reluctance of the magnetic shunt and therefore dynamically modify the maximum output current capable of being delivered by the power supply.

In a further preferred embodiment, a control coil may be formed from an electrically conductive wire wound around a magnetic shunt with the free ends of this wire connected to a rheostat or similar form of variable resistance.

In this mode of operation, the flux in the magnetic shunt will generate currents in the control coil. As the variable resistance is decreased, the amount of current flowing in the control coil will increase, tending to oppose the magnetic flux in the shunt. This will have the effect of increasing the reluctance of the shunt, thereby reducing the effect of the shunt on the transformer.

In one embodiment, an adjustable mounting system may be provided to engage a magnetic shunt with a transformer core to allow the distance between the shunt and the core to be dynamically adjusted. This system can allow the distance between the core and the shunt to be varied depending on the load or application in which the power supply is to be used. For example, in one embodiment a shunt may be mounted on a pair of stanchions with an adjustable ratchet lock system to adjust the height or depth of the shunt relative to the core of the transformer. This arrangement may adjust the relative position of the shunt above or below the transformer's core to in turn adjust the effective reluctance of the shunt and hence its effect on the maximum output current which can be drawn by a load.

In one embodiment the transformer's secondary winding may include a number of terminal connection taps which allow modification of the number of turns within the secondary winding. These taps may provide connection terminals at various points along the length of a conductor forming the entire winding where the connection of a load to a particular tap will select the number of turns present in the secondary winding used.

The provision of multiple output taps on the secondary winding therefore allows for the selection of a particular secondary voltage to be applied to a load. Furthermore, the construction of the present invention ensures that relatively constant power is provided by the supply, so that as the secondary voltage applied increases, the maximum current available to a load will be decreased.

The arrangement and construction of the present invention can also allow for the matching of supply or transformer impedances with the impedance of a load to be supplied with electrical energy. The various control modification systems discussed above, such as for example, adjusting the position of a magnetic shunt relative to a transformer core, adjusting the number and/or geometry of the shunts, the use of a control coil in respect of a magnetic shunt and/or the provision of multiple output taps on the secondary coil can all be employed to effectively modify or control the impedance of the power supply. By matching the impedance of the supply with that of the load efficient power transfers can occur which minimise the waste heat generated through the operation of power supply.

In a further preferred embodiment where a control coil is provided in conjunction with a magnetic shunt, this control coil may be used to superimpose an additional signal or waveform on the output of the transformer. A superposition signal may be applied to such a control coil to control the amplitude and frequency of the voltage applied to a load connected to the power supply. This arrangement of the invention allows for control of the electrical characteristics of the transformer output with components which are isolated from the high current and power levels transferred through the transformer. By inducing a superposition signal through a magnetic shunt control coil, low cost components can be employed, and relatively reliable superposition signal generation element may be provided.

In this specification, unless the context clearly indicates otherwise, the term "comprising" has the non-exclusive meaning of the word, in the sense of "including at least" rather than the exclusive meaning in the sense of "consisting only of". The same applies with corresponding grammatical changes to other forms of the word such as "comprise", "comprises" and so on.

BRIEF DESCRIPTION OF THE DRAWINGS

Preferred embodiments of the invention will now be described, by way of example only, with reference to the accompanying drawings in which.

DETAILED DESCRIPTION OF PREFERRED EMBODIMENTS

Figure 1A:
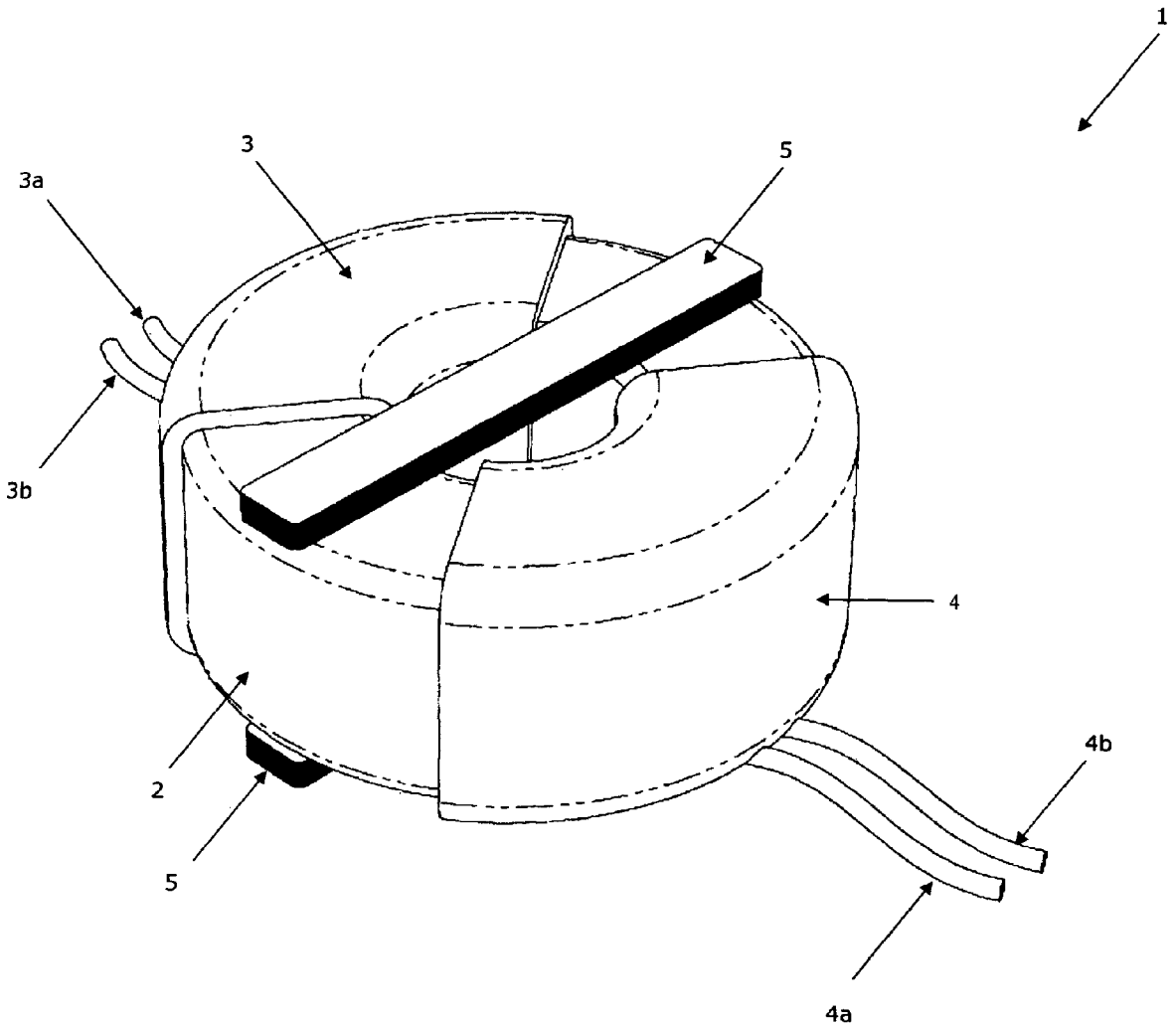
FIGS. 1*a* and 1*b* show perspective and exploded views of a power supply apparatus provided in accordance with a preferred embodiment of the invention.
Figure 1B:
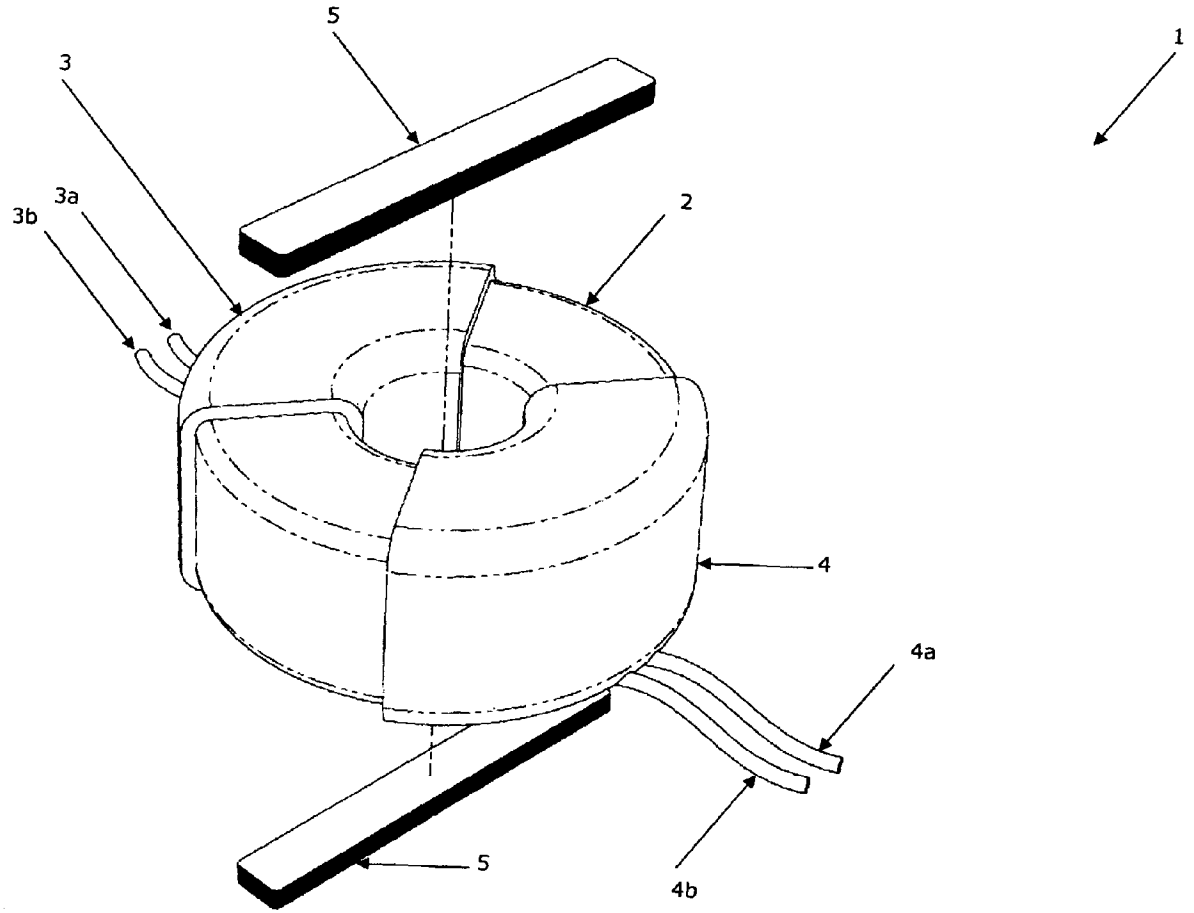

FIGS. 1*a*, 1*b*, 2 and 3 show various views of a power supply apparatus 1 provided in accordance with the preferred embodiment.

The apparatus 1 incorporates a transformer formed from or around a torroidal core 2. A primary winding 3 is wound around the left-hand side of the core 2. A secondary winding 4 is wound around the right-hand side of the core 2. The terminal ends 3*a*, 3*b* of the primary winding 3 are shown, as are the terminal ends 4*a*, 4*b* of the secondary winding.

As can be seen from the drawings provided, the primary winding 3 and secondary winding 4 are located on opposite sides of the core 2.

In the embodiments illustrated with respect to FIGS. 1 to 5, the power supply apparatus 1 includes a pair of bar shaped magnetic shunts 5. One of the shunts is located on the top face of the core 2 whereas the other shunt is located on the bottom face of the core 2.

Figure 2:
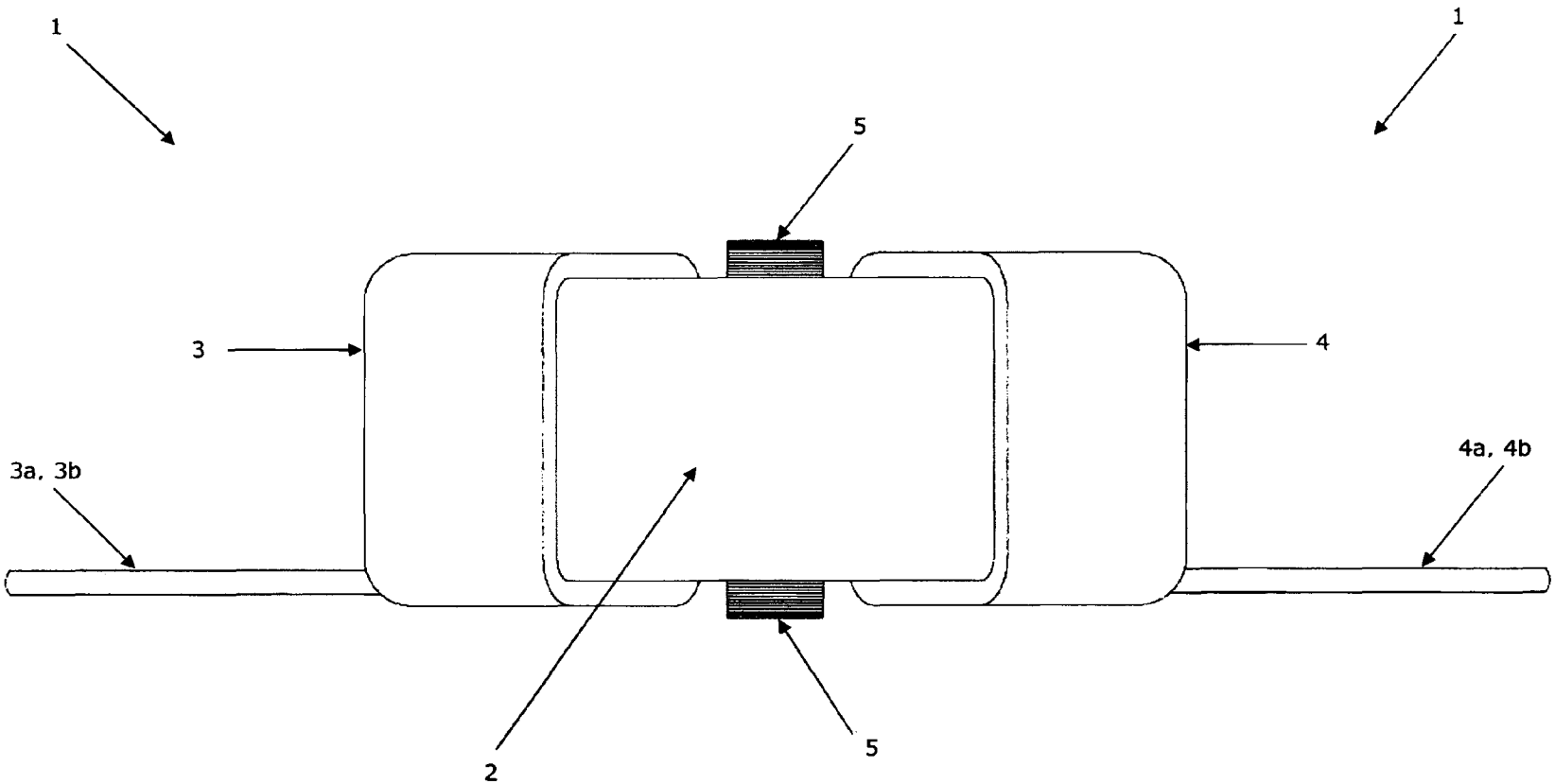
FIG. 2 shows a side view of the power supply apparatus of FIGS. 1*a* and 1*b;*
Figure 3:
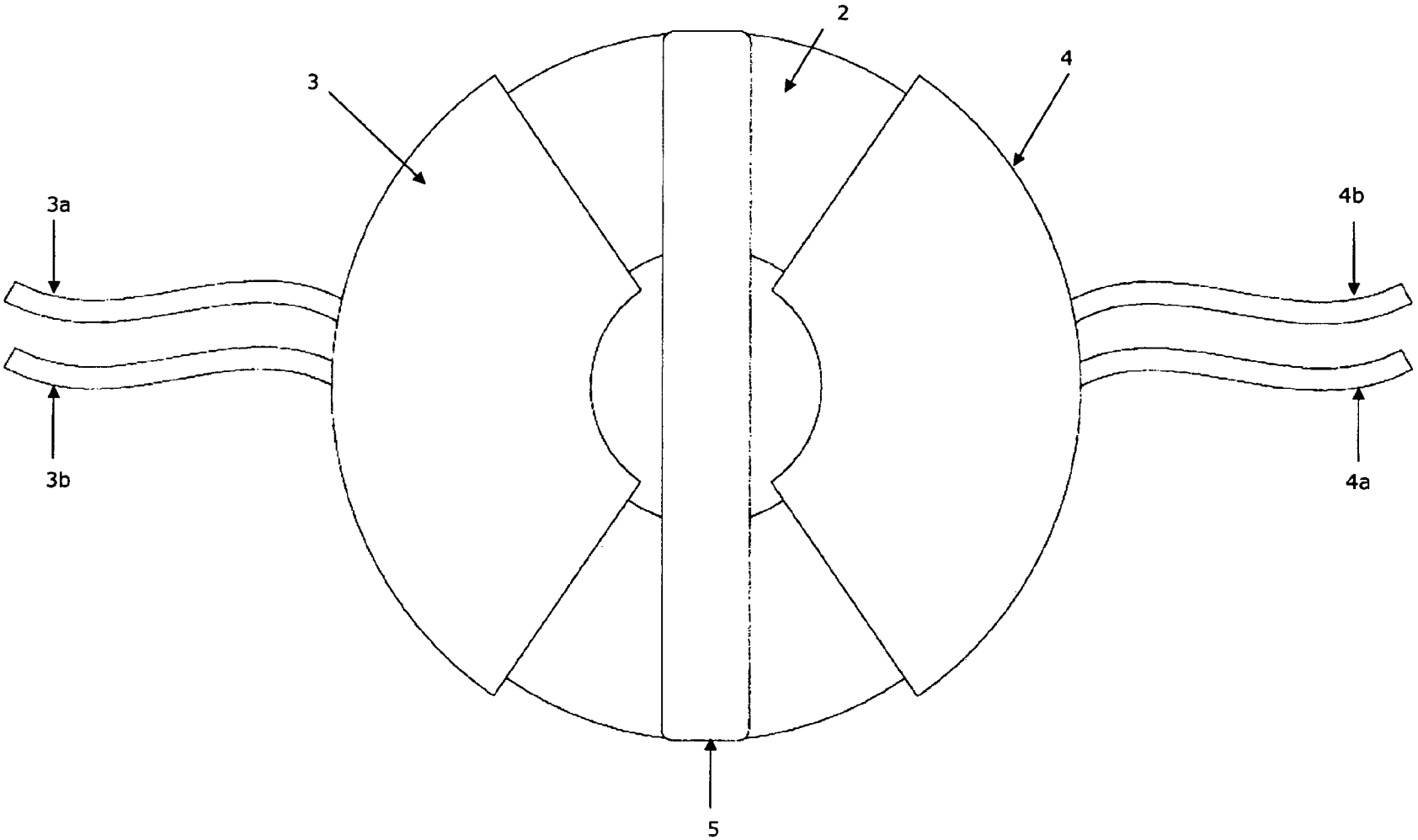
FIG. 3 shows a top plan view of the power supply apparatus of FIGS. 1*a*, 1*b* and 2.

Each shunt 5 extends across the centre of the core 2 and out to the edge or perimeter of the core. In the embodiment illustrated, each magnetic shunt 5 is formed from a number of sections of transformer steel which are laminated together. Each section of transformer steel is therefore electrically isolated from its neighbours. FIG. 2 shows the layering effect employed to construct the shunts 5.

Each of the magnetic shunts 5 provides a diversion path for magnetic flux generated by the primary winding 3 which diverts this flux from the secondary winding 4. By locating each shunt 5 directly between the primary and secondary windings, and by separating the primary and secondary windings onto different sides of the core 2, each shunt can provide an effective diversion path for magnetic flux. The intervention of each shunt 5 acts to reduce the flux affecting the secondary windings 4 and therefore will reduce control of the maximum output current flowing between the secondary winding terminals 4*a*, 4*b*.

Figure 4:
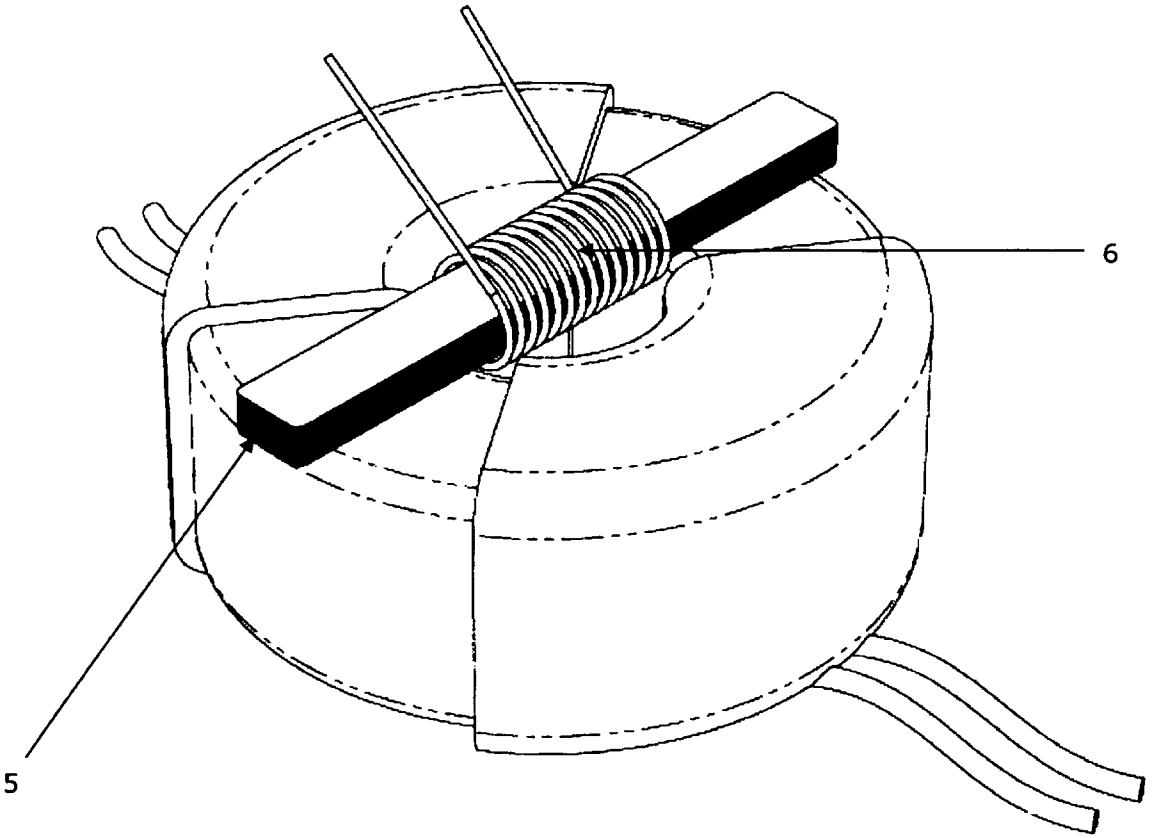
FIG. 4 shows a perspective view of a power supply apparatus provided in accordance with an alternative embodiment which incorporates a control coil.

FIG. 4 shows a perspective view of a power supply apparatus provided in accordance with an alternative embodiment which incorporates a control coil. This control coil 6 is provided in association with the top or upper magnetic shunt 5 by being wound around the centre section of the shunt. The free ends of the control coil 6 are connected to a variable resistance (not shown) with the resistance used alters currents flowing through the control coil to modify the magnetic flux experienced by shunt 5.

Figure 5:
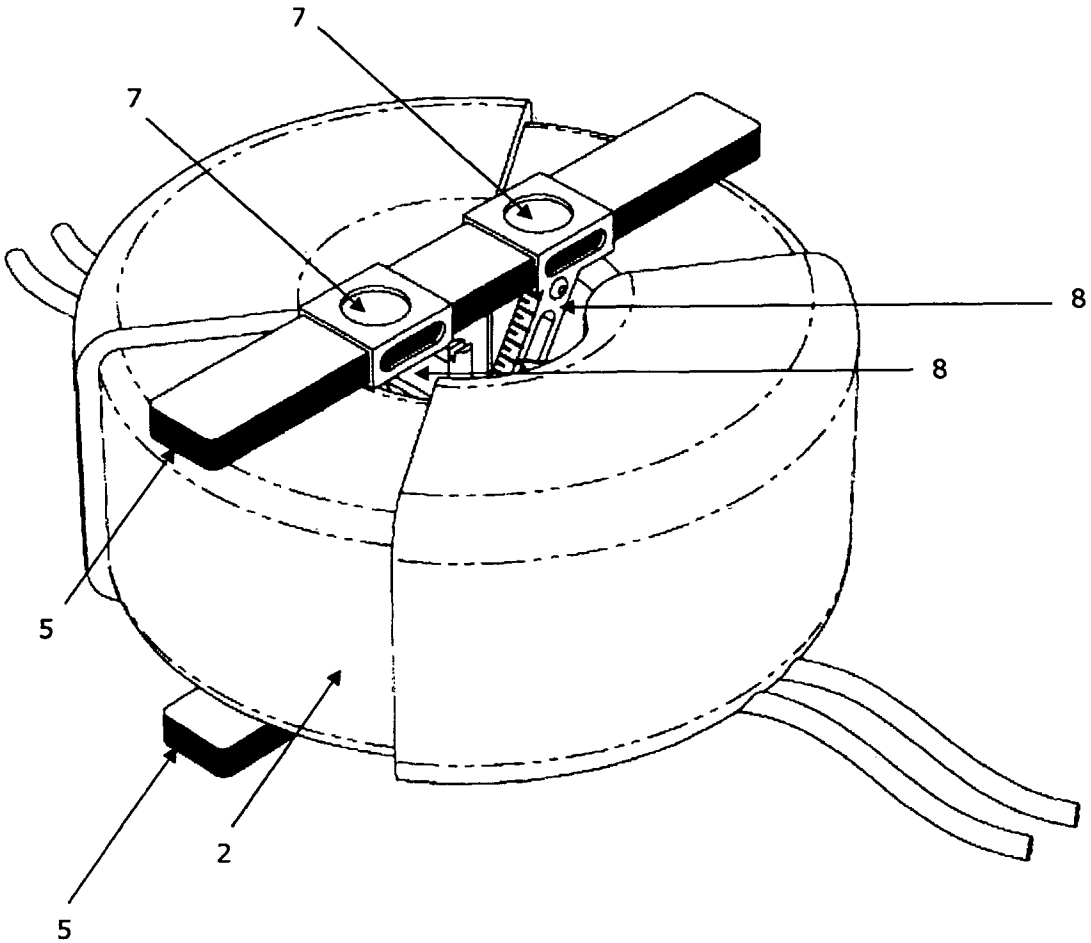
FIG. 5 shows a further embodiment of the invention where the position of the upper or top shunt position relative to a coil can be adjusted.

FIG. 5 shows a further embodiment of the invention where the upper or top shunt position relative to a coil can be adjusted. In this embodiment the distance between the core 2 and upper shunt 5 can be increased to reduce the effect of the diversion path for magnetic flux provided by the upper shunt.

In the embodiment shown with respect to FIG. 5 the top or upper shunt 5 is mounted on the apparatus by a pair of sliding collars 7, each in turn being attached to a pivoting arm 8. When these arms are pivoted towards each other the top shunt is raised above the core 2 to create an air gap. Conversely, as the arms are moved away from one another, the top shunt approaches the core. The arrangement of these arms and hence any air gap between the shunt and the core may be adjusted depending on the current application in which the power supply apparatus is used.

Figure 6:
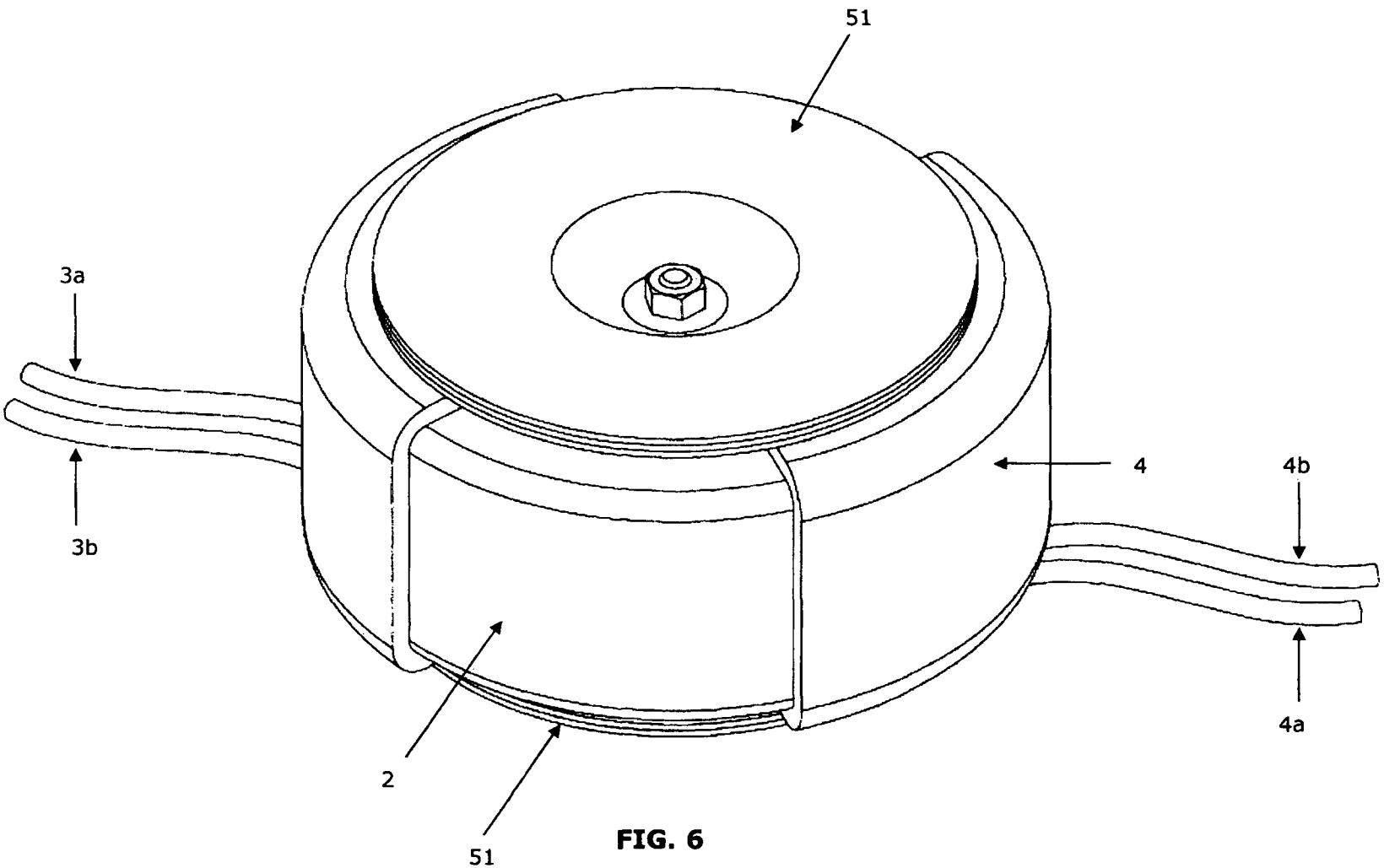
FIG. 6 shows a perspective view of a third embodiment of the power supply apparatus of the present invention.
Figure 7:
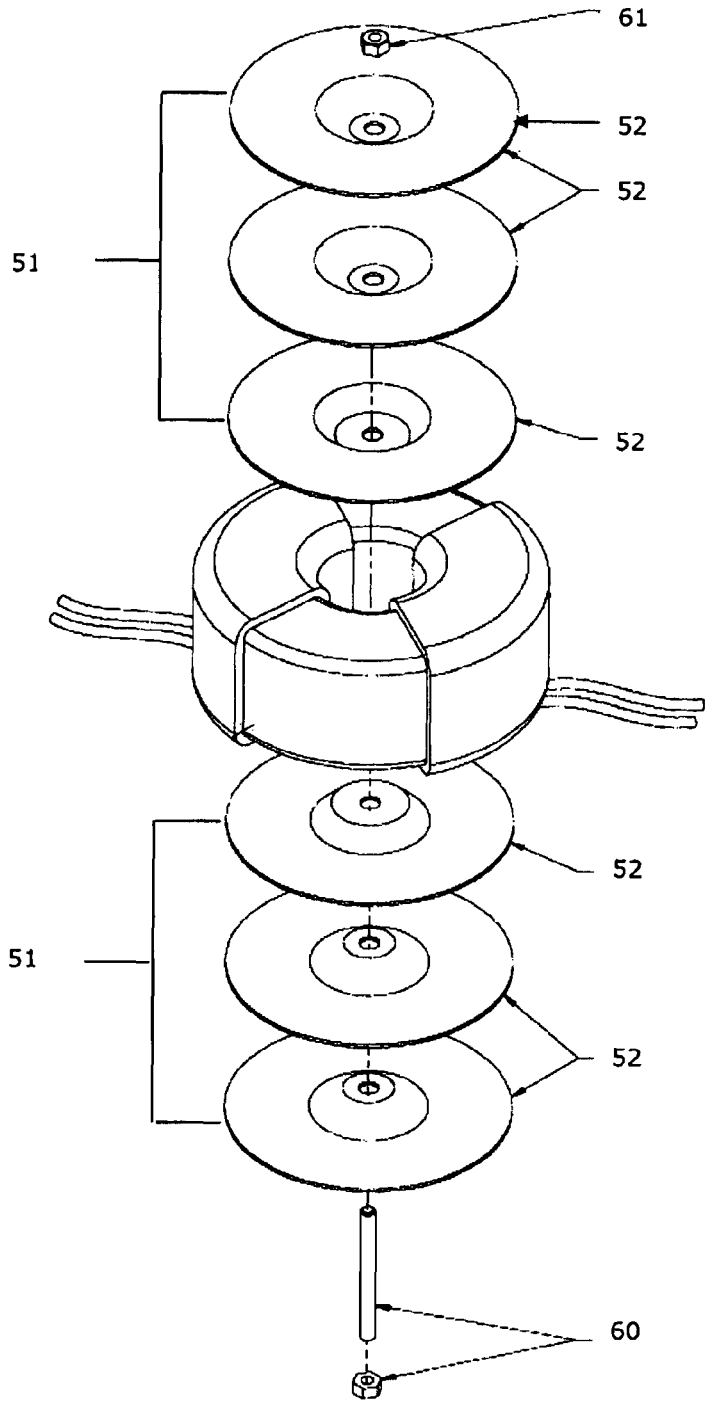
FIG. 7 shows an exploded perspective view of the embodiment of the power supply shown in FIG. 6.

In a further embodiment of the present invention illustrated in FIGS. 6 and 7, whilst the shunts 51 are located on the top and bottom faces of the core 2 as with the first embodiment of the invention, the shunts are in the form of a disk or plate. For consistency, in this further embodiment, similar features of the invention have been identified using the same reference numbers.

The apparatus 1 incorporates a transformer formed from or around a torroidal core 2. A primary winding 3 is wound around the left-hand side of the core 2. A secondary winding 4 is wound around the right-hand side of the core 2. The terminal ends 3*a*, 3*b* of the primary winding 3 are shown, as are the terminal ends 4*a*, 4*b* of the secondary winding.

As can be seen from the drawings provided, the primary winding 3 and secondary winding 4 are located on opposite sides of the core 2.

In the embodiment illustrated with respect to FIGS. 6 and 7, the power supply apparatus 1 includes a pair of disk or plate shaped magnetic shunts 51. Each of the shunts 51 is plate based and similarly to the shunts 5 of the first embodiment, one of the shunts 51 is located on the top face of the core 2 whereas the other shunt is located on the bottom face of the core 2.

Each shunt 51 extends across the centre of the core 2 and out to the edge or perimeter of the core. The magnetic shunts 51 are secured to the torroidal core 2 and each other by way of a centralised fixing hardware 60, preferably in the form of a bolt, pin, shaft or screw, which is inserted through an aperture located in the centre of both of the magnetic shunts 51 and is then secured by way of a mechanical fixer 61, such as a nut or the like.

In the embodiment illustrated, each magnetic shunt 51 is formed from a number of sections of transformer steel which are laminated together. Each section of transformer steel is therefore electrically isolated from its neighbours. Whilst FIG. 2 shows the layering effect employed to construct the shunts 5 of the first embodiment of the invention, the principal of this layering effect is the same for the magnetic shunts 51 of this further embodiment.

The layering of the shunts 51 is shown to some extent in FIG. 7, which shows an exploded perspective view of the construction of the further embodiment of the power supply of the present invention. The layering of the shunts 51 ensures that electrical isolation is maintained between the primary and the secondary windings 2, 3. Each of the magnetic shunts 51 includes a plurality of soft metal disk layers 52 that are insulated from each other.

In the same way as the first embodiment, each of the magnetic shunts 51 provides a diversion path for magnetic flux generated by the primary winding 3 which diverts this flux from the secondary winding 4. By locating each shunt 51 directly between the primary and secondary windings, and by separating the primary and secondary windings onto different sides of the core 2, each shunt can provide an effective diversion path for magnetic flux. The intervention of each shunt 51 acts to reduce the flux affecting the secondary windings 4 and therefore will reduce control of the maximum output current flowing between the secondary winding terminals 4*a*, 4*b*.

It will be apparent that obvious variations or modifications may be made which are in accordance with the spirit of the invention and which are intended to be part of the invention, and any such obvious variations or modifications are therefore within the scope of the invention. Although the invention is described above with reference to specific embodiments, it will be appreciated by those skilled in the art that it is not limited to those embodiments, but may be embodied in many other forms.

The invention claimed is:

1. A power supply apparatus for low impedance loads, comprising:

a transformer having a primary winding and a secondary winding, whereby magnetic flux generated by a varying primary voltage applied to the primary winding induces a secondary voltage on the secondary winding;

a torroidal transformer core over which said primary winding and secondary winding are applied, wherein at least a portion of the secondary winding is spatially separated from said primary winding;

at least one magnetic shunt arranged to provide a diversion path for magnetic flux generated by the primary winding which diverts magnetic flux from the secondary winding; and a control coil operatively associated with the at least one magnetic shunt, the control coil adapted to be connected to a variable resistance whereby the control coil can dynamically modify the reluctance of the at least one magnetic shunt thereby dynamically modifying the maximum output current capable of being delivered by the power supply apparatus.

2. A power supply apparatus as claimed in claim 1, wherein the primary winding is applied to an alternative portion of the torroidal core to the secondary winding.

3. A power supply apparatus as claimed in claim 1, wherein the magnetic shunt extends selectively to at least the perimeter of the torroidal core.

4. A power supply apparatus as claimed in claim 1, wherein the at least one magnetic shunt includes a pair of magnetic shunts located on opposite sides of the torroidal core.

5. A power supply apparatus as claimed in claim 1, wherein the at least one magnetic shunt is formed from laminated sections of transformer steel.

6. A power supply apparatus as claimed in claim 1, wherein the at least one magnetic shunt is a bar shaped magnetic shunt.

7. A power supply apparatus as claimed in claim 1, wherein the at least one magnetic shunt is a plate based magnetic shunt.

8. A power supply apparatus as claimed in claim 2, wherein the magnetic shunt extends selectively to at least the perimeter of the torroidal core.

9. A power supply apparatus as claimed in claim 2, wherein the at least one magnetic shunt includes a pair of magnetic shunts located on opposite sides of the torroidal core.

10. A power supply apparatus as claimed in claim 2, wherein the at least one magnetic shunt is formed from laminated sections of transformer steel.

11. A power supply apparatus as claimed in claim 2, wherein the at least one magnetic shunt is a bar shaped magnetic shunt.

12. A power supply apparatus as claimed in claim 2, wherein the at least one magnetic shunt is a plate based magnetic shunt.

13. A power supply apparatus as claimed in claim 1, wherein the control coil is formed from an electrically conductive wire wound around the at least one magnetic shunt and adapted to have its free ends connected to a variable resistance.

* * * * *